United States Patent [19]

Flynn et al.

[11] 4,149,459

[45] Apr. 17, 1979

[54] SELF INKING HAND STAMP

[76] Inventors: Harold M. Flynn; Terry A. Flynn, both of 5138 E. Taylor St., Phoenix, Ariz. 85008

[21] Appl. No.: 880,701

[22] Filed: Feb. 23, 1978

[51] Int. Cl.[2] ..... B41K 1/10

[52] U.S. Cl. ..... 101/103; 101/111

[58] Field of Search ..... 101/103, 104, 105, 106, 101/111, 327, 333, 334, 108, 109, 110, 97, 98, 101, 84

[56] References Cited

U.S. PATENT DOCUMENTS

| | | | |
|---|---|---|---|
| 2,983,219 | 5/1961 | Weissman | 101/103 |
| 3,101,047 | 8/1963 | Weissman | 101/103 |
| 3,241,482 | 3/1966 | Keck | 101/103 |
| 3,783,786 | 1/1974 | Ellison et al. | 101/333 |
| 4,013,007 | 3/1977 | Flynn | 101/333 |

*Primary Examiner*—J. Reed Fisher

*Attorney, Agent, or Firm*—Warren F. B. Lindsley

[57] ABSTRACT

A self-inking hand stamp incorporating an oscillating motion of the printing assembly which produces an effective printing action even when the hand stamp is not carefully aligned perpendicular to the printing surface. A wiping action of the printing assembly removes excessive ink from the printing characters prior to the printing stroke.

6 Claims, 7 Drawing Figures

SELF INKING HAND STAMP

BACKGROUND OF THE INVENTION

In modern supermarkets and drugstores, the individual items packaged in cans, cartons and other containers are hand stamped to show the selling price. Because hundred or thousands of such items must be marked, the operation becomes a tedious daily routine for the people who stock the shelves, and the speed and efficiency with which it can be accomplished is an important economic consideration. For these reasons, even the slightest improvement in the hand stamp is worthwhile if it contributes to the speed of the operation or to a reduction in operator fatigue.

DESCRIPTION OF THE PRIOR ART

A highly efficient self-inking hand stamping device is described in U.S. Pat. No. 3,783,786. This device provides an indexing printing unit carried in an actuating frame which is forced downward for the printing operation by hand pressure applied to a vertical handle against a restraining spring. As the pressure is subsequently released, the spring returns the printing unit to an upward position and a lever arrangement causes the inking pad to swing under the still vertically aligned printing unit to ink the indexed letters for the next stamping operation.

U.S. Pat. No. 4,013,007 discloses an improved self-inking hand stamp permitting a shorter stroke and also providing a special removable ink pad assembly with associated convenience features.

While these patents disclose significant improvements over earlier stamping device, there are still areas for improvements, especially those relieving the operator from holding the unit in a precisely upright position during stamping in order to achieve a clearly printed marking. There is also a need to provide improved wiping action for clearing excessive ink from the printing characters.

SUMMARY OF THE INVENTION

Therefore, in accordance with the invention claimed, an improved self-inking hand stamp is provided for price marking of retail sales items such as grocery and drugstore products, the improved stamp permitting the operator more freedom in its use with less care required for proper positioning.

It is, therefore, one object of this invention to provide an improved self-inking hand stamp device for price marking retail items.

Another object of this invention is to provide in such a device an improved self-inking arrangement.

A further object of this invention is to provide such a device in which the improved self-inking arrangement makes possible a shorter operating stroke, thereby measurably reducing the operating time of the device and reducing the fatigue experienced by the operator.

A still further object of this invention is to provide an improved hand stamp including means for inducing an oscillatory action of the printing head during the inking and printing operations which results in more thorough inking of the printing characters.

A still further object of this invention is to capitalize on this oscillatory action by relieving the operator of the need for exercising any great care in the assurance of a precisely vertical positioning of the unit during the printing operation.

A still further object of this invention is to provide in the design of the improved hand stamp certain features of construction which facilitate field repairs and replacement of failed parts.

A still further object of this invention is to provide in such an improved hand stamp a wiping means which clears excessive ink from the printing bands prior to stamping.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWING

The present invention may be more readily described by reference to the accompanying drawing in which.

DESCRIPTION OF THE PREFERRED EMBODIMENT

Figure 1:
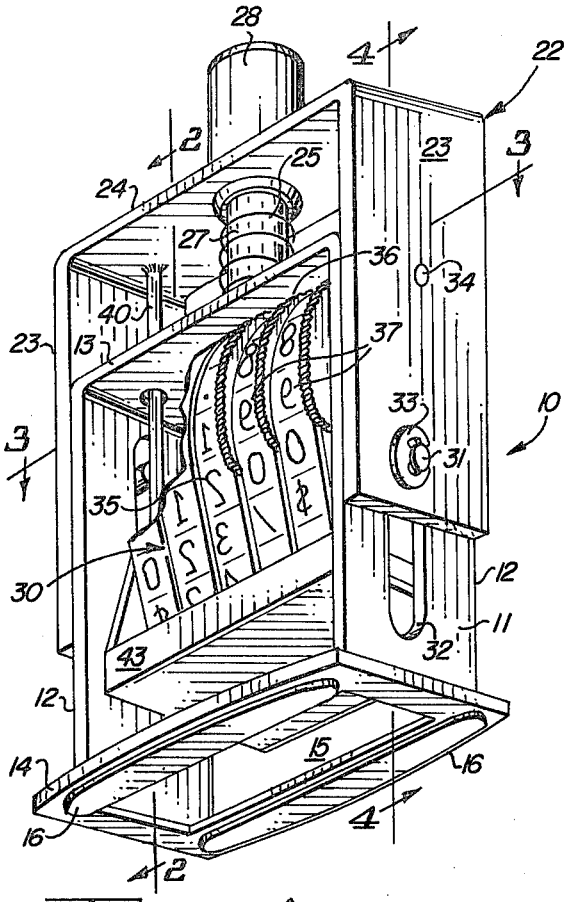
FIG. 1 is a perspective view of the self-inking hand stamp device of the invention.
Figure 2:
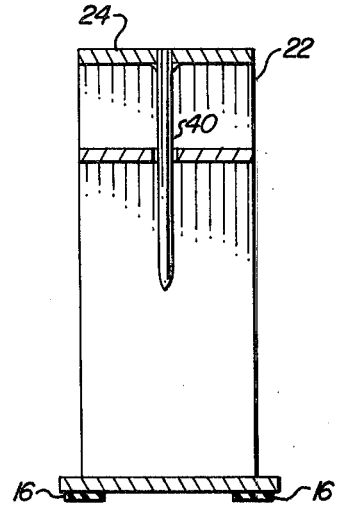
FIG. 2 is a cross-sectional view of FIG. 1 taken along the line 2—2.

Referring more particularly to the drawing by characters of reference, FIGS. 1-7 disclose an improved self-inking hand stamp device 10 comprising a main body frame 11 of generally inverted U-shaped structure having coextensive spaced vertical side or leg bars 12 connected at the top by a horizontal head bar 13 and having their lower ends fixedly secured to a base plate 14. A central clearance opening 15 is formed in the base plate 14 between legs 12 and carrying elastomeric cushioning pads 16 on its lower face.

Mounted on and vertically reciprocable relative to the body frame 11 is a printing unit actuating frame 22 of inverted U-shaped configuration having a pair of spaced coextensive arms 23 which are spaced apart slightly greater than the spacing of frame bars or legs 12 so as to be freely reciprocably movable vertically therealong. Arms 23 are desirably of the same width as legs 12 and being connected integrally by a head bar or web 24. Means for normally biasing frame 22 upwardly relative to frame 11 comprises a coiled compression spring 25 encircling an upwardly projecting stem 27 centrally fixed on the head bar 13 and projecting into a tubular spring housing 28 fixed centrally on and opening downwardly from the head bar 24. The lower end of spring 25 thrusts against the top surface of head bar 13. The housing 28 is provided at its upper end with a blind end shoulder against which the upper end of spring 25 thrusts. In addition, the tubular housing 28 may serve as a handle for manipulating the hand stamp and may be equipped for this purpose with a suitable head knob not shown in the drawing. If desired, frame 22 may be employed as a handle with digital pressure applied to head bar 24 in depressing the printing frame against the bias of spring 25.

Means are provided for guiding arms 23 along bars 12 and for supporting a printing unit 30 to be actuated reciprocably with the printing frame 22. For this purpose, a drive bar 31 is provided to extend through vertical guide slots 32 in the side bars 12 and through holes at opposing centered points at the lower ends of arms 23. Bar 31 is secured in position by means of spring clips 33 which are secured within annular slots at the ends of bar 31 where they protrude through the holes in arms 23. Additionally, two pins 34 fixed to opposing centered points directly above bar 31 on arms 23 extend inwardly through slots 32 to complete the alignment of arms 23 with bars 12.

Figure 3:
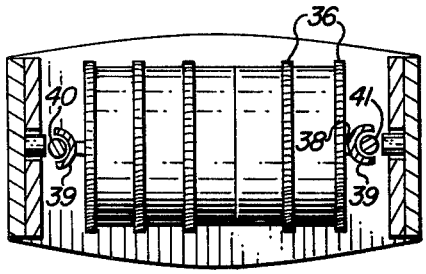
FIG. 3 is a cross-sectional view of FIG. 1 taken along the line 3—3.

The printing unit 30 is similar to customary units of this type and is substantially identical to the printing unit described in the aforementioned U.S. Pat. No. 3,783,786. This unit includes rubber character carrying bands 35, in this instance five, mounted on and about a hidden horizontal bar at the lower end of the unit and about respective adjustment wheels 36 at the opposite end of the unit. Each wheel is provided with a knurled edge digitally engageable adjustment flange of a diameter to project sufficiently beyond printing characters 37. Printing characters 37 may be numbers, punctuation marks or letters in series on the outer faces of the bands to enable convenient belt adjusting rotation of the wheels without contacting the characters by the manipulating fingers. Coaxial individually rotatable mounting of the wheels 36 is effected on a shaft 38 secured fixedly to and between the upper end portions of guide tracks 39 as shown in FIG. 3. The vertical tracks 39 are attached at their lower ends to bar 31 so that shaft 38, tracks 39 and bar 31 comprise a rectangular framework for the printing unit 30. Tracks 39 are in the form of vertical U-shaped channels opening outward.

Attached to and extending vertically downward from the under surface of head bar 24 are two pins 40 and 41, each of which is aligned with one of the guide tracks 39 so that the lower end of pin 40 or 41 moves in parallel relationship with tracks 39 inside the outwardly opening channels formed by tracks 39 as shown in FIG. 3. Clearance holes 42 in horizontal head bar 13 are provided to permit passage of pins 40 and 41 through head bar 13 as frame 22 is moved vertically relative to frame 11.

The confinement of pins 40 and 41 within the channels formed by tracks 39 loosely secures the approximate parallel alignment of printing unit 30 which is secured to tracks 39 and frame 22 which carries the pins 40 and 41. This approximate alignment is maintained as frame 22 is driven downward during the printing operation. At the lower end of the printing stroke, however, the loose fit between pins 40 and 41 inside the channels of tracks 39 permits the printing head 30 to oscillate or vibrate in pivotal fashion about drive bar 31, the amplitude of the oscillation being limited by the amount of play or clearance between pins 40 and 41 and channels of tracks 39. The oscillating action causes the printing characters 37 to rock back and forth on the printing surface as they strike it so that effective ink transfer from characters to surface is effected even though the printing unit 30 may not be precisely perpendicularly aligned with the surface. A primary object of the invention is thus achieved through the oscillating action.

Means are provided for not only efficient positive adjustment driving of the belts or bands 35 by wheels 36 but also effective indexing and retention of the bands in adjusted positions thereof. To this end, the endless bands 35 are desirably molded from an elastomer such as neoprene of 40–50 durometer and mounted on the printing unit under slight tension. Elasticity of the respective bands is improved by providing fairly deep transverse grooves between the relatively stiffer areas of the bands providing the characters 37 which have flat face planes. The character areas are thus separated by relatively flexible elastic integral webs which are preferably molded longitudinally in a slight inside concave outside convex form. Between the webs, the back faces of the respective bands are provided with traction means desirably comprising transverse serration like resilient rib teeth which are dimensioned to mesh with and are complementary to similar transverse rigid rib teeth on the drum perimeters of wheels 36. This effects a fairly positive drive relationship between the wheels and bands and eliminates any need for backing on the bands, enabling a smoother, freer, easier adjustment manipulation of bands 35 through wheels 36.

For indexing, a cooperative relationship is provided between bands 35 and the hidden horizontal bar at the lower end of the printing unit 30. As is customary, the hidden bar provides a rigid thrust backing for the character areas of the bands to enable applying printing impressions of the printing characters 37 aligned on the bar onto objects against which impressed by thrusting the printing end of the printing unit 30 through the clearance opening 15 in base 14.

The guide tracks 39 are integral with the hidden bar in a U-shaped unit, the tracks forming the vertical sides and the bar forming the horizontal base.

Self-inking means are provided automatically operative to apply ink to the printing characters aligned along the lower end of unit 30. According to the present invention such means comprises an inking device 43 constructed and arranged to move automatically into inking position when the printing unit 30 is in retracted position within the body frame 11 and to move automatically into clearance relationship to the printing unit when the printing unit is actuated into printing position by depressing the printing frame 22 relative to the body frame 11.

Further, the inking device 43 is constructed and arranged for greatly facilitating supplying it with ink. To this end, inking device 43 comprises a pair of side plates 44 of identical, coextensive construction in spaced parallel relationship. These side plates are generally of rectangular configuration rigidly connected together along their lower aligned edges by a pair of spaced parallel coextensive rods 45 and 46. One rod is fixedly secured adjacent one corner area of the configuration and the other to the other corner area thereof.

In addition to serving as frame connectors for the side plates, rods 45 and 46 provide means for supporting an ink pad 47. Such pad comprises a suitable panel of ink-carrying and applying material. Commonly an absorbent felt pad has been used for this purpose, but significantly improved results are obtained by means of a pad of suitable thickness of interconnected cellular resilient foam material such as foam latex, polyvinylchloride foam, or the like. This improved material has minutely dimensioned porosity so as to be possessed of large ink capacity having a strong, fairly uniform and adequately dense but porous applicator surface. It has been found that such material provides a continuously uniform application of ink to the printing characters as long as there is any ink on and in the pad.

For supporting the ink pad 47 operatively, an ink pad tray 48 is provided, the tray carrying a wrap around hinged flange 49 at its inboard edge and a snap-latch flange 51 at its outboard edge. The hinge flange 49 captures rotatably but non-removably rod 46 and the snap-latch flange 51 gripping rod 45. Flange 51 may be disengaged from rod 45 and tray 48 may be tilted downwardly to facilitate removal or inking of pad 47.

The inking device 43 comprising tray 48 and side plates 44 secured together by rods 45 and 46 is pivotally mounted to frame 11 by means of two pins 52. Each pin passes through an upper corner of one of the side plates 44 at the outer edge of the plate. The two pins 52 are directly opposite each other. Two pivot arms 53 are provided which cause device 43 to be rocked into position for inking beneath the printing unit 30 when frame 22 is retracted upwardly and to be rocked to one side away from unit 30 as frame 22 is driven downward during the printing stroke.

The two pivot arms 53 are positioned at opposite sides of device 43. Each arm 53 is a simple flat rectangular strip with a round hole through each end. The two arms are pivotally attached at opposite ends of rod 46 which also carries the hinged flange 49, the flange 49 confining arms 53 to the opposite end positions of rod 46. The rod 46 passes through one of the two holes in each of the arms 53. The other end of each of the arms 53 is pivotally supported by the drive bar 31 which passes through the second hole in each of the arms.

Figure 4:
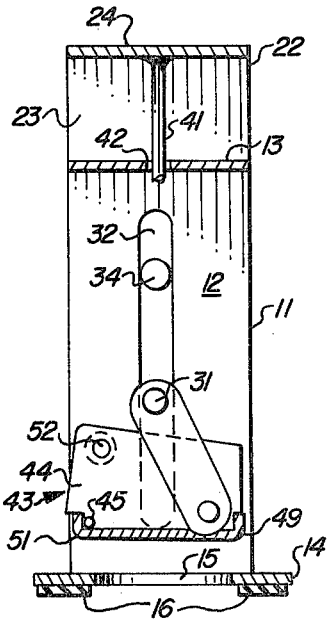
FIG. 4 is a cross-sectional view of FIG. 1 taken along the line 4—4.
Figure 5:
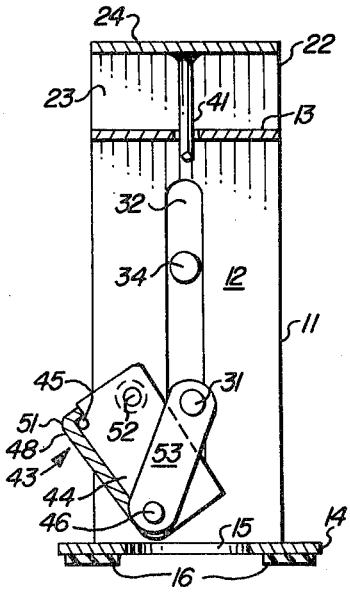
FIG. 5 is a second cross-sectional view of FIG.1 taken along the line 4—4 with the printing head partially lowered from the raised position shown in FIG. 4.
Figure 6:
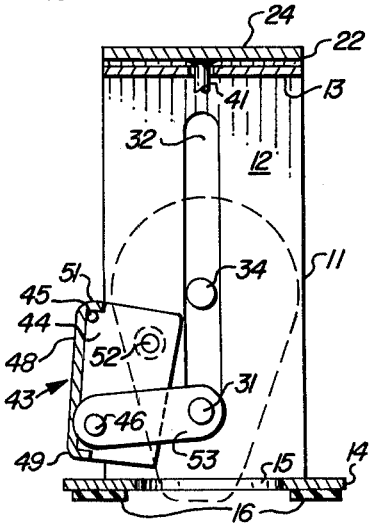
FIG. 6 is a third cross-sectional view of FIG. 1 taken along line 4—4 with the printing head fully lowered to the printing position.

As shown in FIG. 4, tray 48 is in a horizontal position when frame 22 is retracted upwardly and pad 47 is brought to bear against the printing characters 37 which are set at the printing end of the printing unit 30. Arm 53 is displaced slightly from the vertical. As frame 22 progresses downwardly during the printing stroke as shown in FIG. 5, the drive bar 31 transmits a downward displacement through arm 53 to rod 46, the downward displacement or rod 46 causing device 43 to rotate in a clockwise direction about pins 52 so that device 43 is rocked to the left and is moved out of the way of the descending printing unit 30 until at the fully lowered or printing position of the frame 22 the inking device 43 has been moved completely clear of the device 30. As frame 22 is subsequently raised after printing, the reverse action of bar 31 acting through arms 53 again rotates inking device 43 in a counter-clockwise direction about pins 52 causing it to rock back into inking position below the printing unit 30.

Figure 7:
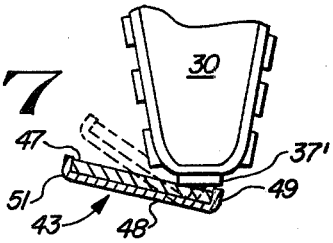
FIG. 7 is a partial side view of FIG. 1 showing the wiping action which occurs during the initial portion of a printing stroke.

In the realization of another primary object of the invention, the upward extension of the edge of the hinged flange 49 is such that it brushes over the surfaces of the positioned printing characters 37' as the inking device rocks out of the way from the inking position. The brushing action causes excess ink to be removed from the inked characters prior to the printing stroke so that any tendancy to smudge is effectively reduced. FIG. 7 illustrates the brushing or wiping action provided.

The pivotal mounting of the inking device 43 by means of pins 52 and arms 53 is in contrast to the slotted arrangement employed in the prior art shown in U.S. Pat. No. 3,783,786 wherein the drive bar slides within a slot of the inking device to rock the inking device out of the way. The sliding action produces excessive wear on the edges of the slots so that the mechanism soon wears out and must be replaced or the entire printing device must be discarded.

The pivoting arrangement provided in the present invention is less prone to such early deterioration. In addition, provision is made for easy replacement of the entire inking device 43 along with arms 53. Pins 52 have tapered heads similar to the heads of wood screws or of counter-sinking machine screws, and they pass through the side bars 12 of the frame 11 from the outside. The heads of pins 52 fit into countersunk holes in the side-bars 12 so that the surfaces of the heads of pins 52 are flush with the outer surfaces of the side-bars 12. In all positions of frame 22 including the fully-retracted upward position, the heads of pins 52 are covered by arms 23 of frame 22 which thus trap and confine pins 52 within their holes in side-bars 12. To disassemble and remove the inking device, one has only to withdraw the drive bar 31 after removing clip 33. Frame 22 may then be further retracted or pivoted to clear the heads of pins 52. The disassembly and replacement of inking device 43 proceeds easily from this point without the aid of special tools.

Although but a single embodiment of the present invention has been illustrated and and described, it will be apparent to those skilled in the art that various changes and modifications may be made therein without departing from the spirit of the invention or from the scope of the appended claims.

What is claimed is:

1. A hand stamp assembly comprising an upright body frame having matched elongates slots including a base to be thrustingly engaged with an object to be imprinted, a printing frame, a printing unit within the body frame and operatively coupled with said printing frame by means of connecting means from the printing unit to the printing frame riding in said slots, said printing unit having character-carrying means movable to shift different printing characters thereon into printing position facing toward said base, and means normally biasing the printing frame and thereby the printing unit into a retracted position on the body frame away from said base and from which position the printing frame can be moved in opposition to the biasing means to drive the printing characters into imprinting engagement with an object against which the base is thrustingly engaged, including:

a pair of pins spacedly mounted at a common end within said printing frame, each of said pins being arranged to extend through a different aperture in said body frame to position one on each side of said printing unit, a pair of guiding channels one mounted on each side of said printing unit and arranged to extend longitudinally of its length for each receiving therein the free end of one of said pins, said pins guiding said printing unit upon movement of said printing frame and printing unit toward the object to be imprinted, said apertures in said body frame and the diameter of said guiding channels being slightly larger than the diameter of said pins so that said printing unit may oscilate relative to said printing frame about said connecting means when said printing unit strikes a surface of an object to be imprinted which is not perpendicularly aligned with said upright body frame.

2. The hand stamp assembly set forth in claim 1 in further combination with:

an ink pad supporting tray hingedly mounted on said body frame, means normally holding said tray in position on said body frame to support the ink pad for its inking function and being releasable for swinging the tray away from the inking position during movement of said printing unit into imprinting engagement with an object, said tray having an edge which contacts in a wiping action said character carrying means during movement of said printing unit to imprinting engagement with the object.

3. The hand stamp assembly set forth in claim 2 wherein:

said edge is an inboard edge of said tray.

4. The hand stamp assembly set forth in claim 3 wherein:

said edge is turned back on itself inwardly of the tray.

5. The hand stamp assembly set forth in claim 2 wherein:

said means for normally holding said tray in position on said body frame comprises a pair of pins each having a head arranged to fit inwardly of said body frame in countersunk holes of said body frame whereby said ink tray may be easily removed from said body frame.

6. The hand stamp assembly set forth in claim 1 wherein:

said pair of pins extend within said printing frame at its end opposite to the object engaging end of the assembly.

* * * * *

UNITED STATES PATENT OFFICE

CERTIFICATE OF CORRECTION

Patent No. 4,149,459 Dated 4-17-79

Inventor(s) Harold M. Flynn and Terry A. Flynn

It is certified that error appears in the above-identified patent and that said Letters Patent are hereby corrected as shown below:

In claim 1, line 2, delete "elongates" and substitute ---elongated---.

Signed and Sealed this

*Thirty-first* Day of *July 1979*

[SEAL]

*Attest:*

*Attesting Officer*

LUTRELLE F. PARKER

*Acting Commissioner of Patents and Trademarks*